US007178275B2

(12) United States Patent
Grunert et al.

(10) Patent No.: US 7,178,275 B2
(45) Date of Patent: Feb. 20, 2007

(54) METHOD OF OPERATING A DRYING AND PRESSING APPARATUS FOR ITEMS OF CLOTHING AND A DRYING AND PRESSING APPARATUS

(75) Inventors: Klaus Grunert, Berlin (DE); Peter Nober, Rommersheim (DE); Dimitri Pischits, Raunheim (DE); Leo Zeimetz, Büttelborn (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 44 days.

(21) Appl. No.: 10/978,195

(22) Filed: Oct. 29, 2004

(65) Prior Publication Data

US 2005/0184107 A1 Aug. 25, 2005

(30) Foreign Application Priority Data

Oct. 29, 2003 (DE) ..... 103 50 507

(51) Int. Cl.
*D00F 73/00* (2006.01)
*D06F 71/13* (2006.01)

(52) U.S. Cl. ..... 38/70

(58) Field of Classification Search ..... 223/52, 223/68, 69, 70, 71, 72, 73, 74, 76, 77, 79, 223/80; 38/1 R, 12, 14, 16, 19, 44, 1 A, 38/1 C, 1 D, 63, 64
See application file for complete search history.

(56) References Cited

U.S. PATENT DOCUMENTS 2,060,234 A * 11/1936 Mikulasek ..... 38/63
2,543,485 A * 9/1951 Briggs ..... 312/27
3,184,127 A * 5/1965 Smith ..... 223/67
3,429,489 A * 2/1969 Blevens ..... 223/67
3,439,847 A * 4/1969 Swain ..... 223/70
3,478,941 A * 11/1969 Dayton et al. ..... 223/67
3,512,703 A * 5/1970 Buckley et al. ..... 223/70
3,563,428 A * 2/1971 Rasmussen ..... 223/70
6,237,261 B1 * 5/2001 Hickle et al. ..... 38/7

FOREIGN PATENT DOCUMENTS

DE 100 63 671 A1 6/2002

* cited by examiner

*Primary Examiner*—Ismael Izaguirre
(74) *Attorney, Agent, or Firm*—Craig J. Loest; Russell W. Warnock

(57) ABSTRACT

A drying and pressing apparatus for items of clothing has a flexible pressing dummy which can be subjected to the action, from the inside, of an air stream generated by a fan. The apparatus has a top framework and a bottom framework. The pressing dummy has one section connected to the top framework and one section connected to the bottom framework, and it is possible for the top framework to be retracted into a retracted position in the bottom framework and extended out of the bottom framework into an extended position. A locking device is provided for locking the top framework in relation to the bottom framework. By use of an unlocking input device for unlocking the locking device, it is possible, upon actuation of the input device, to unlock the locking device for a predetermined unlocking duration. This ensures a straightforward and nevertheless reliable operating sequence of the apparatus.

48 Claims, 2 Drawing Sheets

METHOD OF OPERATING A DRYING AND PRESSING APPARATUS FOR ITEMS OF CLOTHING AND A DRYING AND PRESSING APPARATUS

BACKGROUND OF THE INVENTION

FIELD OF THE INVENTION

The invention relates to a method of operating a drying and pressing apparatus for items of clothing, having a flexible pressing dummy, and to a control device with an associated input panel for a drying and pressing apparatus for items of clothing which has a pressing dummy.

Published, Non-Prosecuted German Patent Application DE 100 63 671 A1 discloses a shirt-pressing apparatus with a bottom part and a top framework and a flexible inflatable dummy installed between the top framework and the bottom part. When the pressing apparatus is not in use, the top framework can be retracted into the bottom framework. Accordingly, the pressing dummy can assume a retracted position and an extended position and has a locking device in order to lock the top framework in the extended position in relation to the bottom part.

A drying and pressing apparatus for items of clothing which has a flexible pressing dummy which can be subjected to the action, from the inside, of an air stream generated by a fan is also known. The apparatus is provided with a heater for heating the air stream. The apparatus can be set in operation by rotation of a rotary knob, with the result that the fan and the heater are started in order to dry and press an item of clothing mounted on the pressing dummy and, via the angle of rotation of the rotary knob, it is possible to set a duration during which the fan and the heater remain in operation. During the preselected duration, the rotary knob rotates back to the starting position.

SUMMARY OF THE INVENTION

It is accordingly an object of the invention to provide a method of operating a drying and pressing apparatus for items of clothing and a drying and pressing apparatus which overcomes the above-mentioned disadvantages of the prior art methods and devices of this general type, which ensures straightforward and reliable operation of the apparatus.

The drying and pressing apparatus for items of clothing has a flexible pressing dummy which can be subjected to the action, from the inside, of an air stream generated by a fan. The apparatus has a top framework and a bottom framework, the pressing dummy has one section connected to the top framework and one section connected to the bottom framework. It is possible for the top framework to be retracted into a retracted position in the bottom framework and extended out of the bottom framework into an extended position. Also provided are a locking device for locking the top framework in relation to the bottom framework in the retracted position and/or the extended position, and an unlocking input device for unlocking the locking device, in which case, upon actuation of the unlocking input device, the locking device is unlocked and retained in the unlocked position for a predetermined unlocking duration. During the unlocking duration, the user is capable of displacing the top framework in relation to the bottom framework into either the retracted position or the extended position.

Once the unlocking duration has elapsed, the locking device automatically drops back into the locked state and, when one of the end positions, such as the retracted position or the extended position, is reached, the locking device automatically locks in the end position. When one of the end positions is reached and the unlocking duration has not yet elapsed, the locking device is locked in the respective end position. Reliable locking is thus possible when one of the end positions is reached.

During the unlocking duration, which preferably lasts two seconds, an indicating device, which is preferably formed by an indicator lamp, indicates this state. The user thus knows that he/she can then displace the top framework in relation to the bottom framework.

The locking device has an electric drive, preferably an electromagnetic lifting drive, which, for unlocking purposes, is operated over an initial breakaway duration of preferably 0.03 to 0.5 s at a high power and over a following holding duration of preferably 1.5 to 1.97 s at a low power, which is lower than the high power. Once the unlocking duration has elapsed, the locking device is moved back into the locked position by a prestressing device, which is preferably configured as a spring.

The locking device is disposed on the bottom framework and has a bolt that, for locking purposes, is brought into engagement with a top or bottom undercut provided on the top framework. Disposed between the top and the bottom undercuts is a sliding rail via which the bolt slides when the locking device is located in the locked position and the top framework is located in an intermediate position between the retracted position and the extended position.

The bolt has a sliding body by which the bolt comes into contact with the sliding rail, the sliding body having friction-reducing and impact-absorbing properties.

Since the electric drive is grounded, the top framework cannot be energized via the bolt in the event of a malfunction of the electric drive.

The extended position of the top framework is sensed via a sensor device, and the drying and pressing apparatus is ready for operation only when the extended position of the top framework is sensed.

The apparatus is equipped with an adjustable program-input device for selecting an operating program and with a switch for starting the preselected operating program. It is thus possible for the operating program, once selected, to be started via actuation of the start switch. This ensures straightforward operation of the drying and pressing apparatus. Actuation of the start switch, when a preselected program is started, starts the fan for the air stream and, if appropriate, a heating device for heating the air stream.

If it is necessary, in the case of a set operating program, for the fan and the heating device to be operated simultaneously, then the fan is switched on just prior to the heating device and, at the end of the operating program, the fan is switched off prior to the heating device. Staggering the times retains the initial maximum power consumption at a relatively low level, with the result that the power supply is not overloaded even for a short period of time. Switching on the heating device following the fan and switching it off prior to the fan ensures good heat dissipation from the heating coils of the heating device, which contains a permanent heater, and ensures that the heating device is not adversely affected.

A multiplicity of different operating programs can be set by adjustment of the program-input device. It is preferably possible to set three different operating programs by adjustment of the program-input device.

For each operating program, a control device stores a predetermined amount of work in dependence on parameters such as volume flow (l/s) of the air stream, the temperature of the air stream or the duration of the air stream, or, for each operating program, a control device stores a predetermined duration and/or a predetermined temperature and/or a temperature profile over the duration for the air stream. The amount of work or duration and/or the temperature and/or the temperature profile of an operating program are/is predetermined in dependence on the material of an item of clothing which is to be treated, and account is taken of the amount of work or the temperature and/or the temperature profile and/or the duration in dependence on the water-absorption capability of the material of the item of clothing which is to be pressed, and the amount of work or the duration and/or the temperature and/or the temperature profile are/is longer and/or higher in the case of material with a high level of water-absorption capability, such as flannel, than in the case of material with a lower level of water-absorption capability, such as silk.

The end of a preselected operating program, in particular the end of the heating phase, is reached when the integral of the power consumed over time corresponds to the amount of work stored for the preselected operating program and/or when the duration predetermined for an operating program has elapsed.

The operating programs contains:

a) "cold ventilation" with ambient air at a first temperature;

b) "warm ventilation" with a preheated air stream at a second temperature; and c) "pressing" with a preheated stream at a third temperature, which is higher than the second temperature at least temporarily, preferably following the starting phase.

For the pressing operating program, provision is made for a heat accumulator, which is part of the heating device, to be preheated or charged to a predetermined quantity of heat. Upon preselection of the pressing operating program, the preheating, or charging, of the heat accumulator is started. Upon actuation of the start switch, only when preheating is completed, the operating program is started. During the preheating or the charging and at the end of the preheating or charging of the heat accumulator, an indicating device, preferably an indicator lamp, indicates that the heat accumulator is being preheated or charged or has been preheated or charged.

In an advantageous configuration, if the heat accumulator has been preheated and is retained at the preheated level and, once a predetermined duration of preferably 30 minutes has elapsed, a pressing operating program does not start, an acoustic and/or optical signal are/is emitted, and/or the apparatus is switched off, with the result that the apparatus can only be operated again by actuation of the main switch, and/or the apparatus is switched into a rest mode in which the preheating of the heat accumulator is switched off, the rest mode being terminated by actuation of the start switch or some other input device. This prevents the situation where the heat accumulator is always retained in the preheated or charged state if the user has forgotten to switch off the apparatus properly via the main switch, and thus disconnect it from the power supply, following use.

At the end of the warm ventilation and/or pressing operating program, a cold ventilation phase with a predetermined duration is provided in order to fix the dried and/or pressed item of clothing.

At the end of an operating program, the fan and/or the heating device are/is switched off and an acoustic and/or optical signal are/is emitted, in order that the user is informed of the fact that the operating program has been completed.

A signal-setting input device, by which the "operating program at an end" signal can be changed and switched on or off, is provided, it being possible, in the case of an acoustic signal, in particular for the loudness of the acoustic signal or the signal (melody) itself to be changed.

When a new operating program is set on the program-input device as a current program is running, the set change in program is taken into account only for the next operating cycle, the currently running program being executed to completion.

A stop switch is provided, it being possible for a currently running operating program to be stopped at any point in time using the stop switch.

If, as an operating program is running, the operating program is stopped by actuation of the stop switch and, within a predetermined duration of preferably 30 seconds, the start switch of the operating program is actuated, then the operating program is continued at the point at which it was stopped. Once the predetermined duration of preferably 30 seconds has elapsed, actuation of the start switch causes the set operating program to start from the beginning.

For starting and stopping a preselected operating program, it is possible to provide a single button for the start and stop functions.

A main switch is also provided for switching the apparatus on and off. The apparatus is initialized following actuation of the main switch, the function of at least one current-carrying component, preferably of all current-carrying components, being checked via respective test routines. If one or more malfunctions of components of the apparatus are detected, the apparatus is only partially freed for operation, if at all.

If malfunctions of components of the apparatus are detected during operation of the apparatus, then the apparatus is switched off or is only partially operational.

The apparatus is provided with a defect memory in which malfunctions of components of the apparatus that are detected during initialization or during operation of the apparatus are stored and can be read out again.

Upon initialization, the defect memory is interrogated and, in the presence of stored malfunctions, the apparatus is only partially freed for operation, if at all.

Other features which are considered as characteristic for the invention are set forth in the appended claims.

Although the invention is illustrated and described herein as embodied in a method of operating a drying and pressing apparatus for items of clothing and a drying and pressing apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
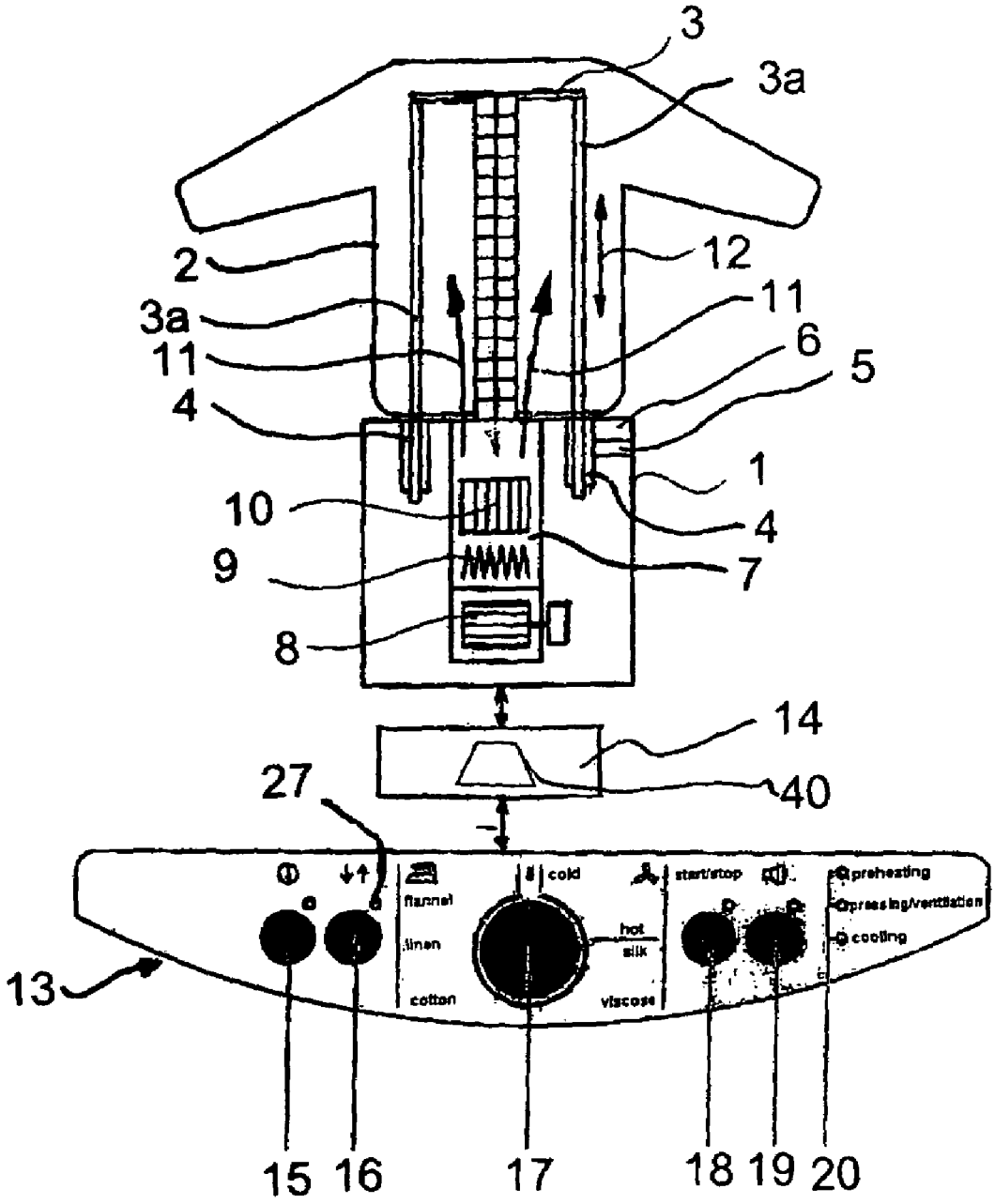
FIG. 1 is a diagrammatic illustration of a drying and pressing apparatus for items of clothing according to the invention.

Referring now to the figures of the drawing in detail and first, particularly, to FIG. 1 thereof, there is shown a drying and pressing apparatus for items of clothing. The apparatus has a bottom framework 1 with a flexible pressing dummy 2 disposed on its top section. Disposed within the pressing dummy 2 is a top framework 3 that can be retracted into the bottom framework 1, and extended out of the bottom framework 1, via a guide device 4. Accordingly, the top framework 3 can assume a non-illustrated retracted position and an extended position (shown in FIG. 1). Via a locking device 5, the top framework 3 can be locked in relation to the bottom framework 1 both in the extended position and in the retracted position. A sensor device 6 is provided in order to sense whether the top framework 3 is located in the extended position and/or in the retracted position.

The bottom framework 1 contains an air-guiding channel 7, in which are disposed a heating device 9 and a fan 8 for generating an air stream 11. The heating device 9, in addition to a permanent heater has a heat accumulator 10 which can be preheated or charged with a predetermined quantity of heat. Via the air-guiding channel 7, ambient air is taken in and blown from beneath into the flexible and air-permeable pressing dummy 2. If an item of clothing, e.g. a shirt, T-shirt or jacket, is located on the pressing dummy 2, then this item of clothing is shaped and dried, and thus also pressed, by the preheated air stream 11 being introduced and the pressing dummy 2 being inflated. An input panel 13 is disposed on the bottom framework 1 and is connected for signal-exchange purposes to a control device 14, the control device 14 being connected in control terms to the respective structural units of the drying and pressing apparatus.

The input panel 13 has a main switch 15, an unlocking input device 16 in the form of a button or unlocking button for activating the locking device 5, a program-input device 17 in the form of a rotary actuator for selecting an operating program, a start/stop button 18, a signal-setting input device 19 for changing and switching a "program end" signal on/off, and indicating devices 20 for indicating the currently running operating programs or operating states of the drying and pressing apparatus.

Figure 2:
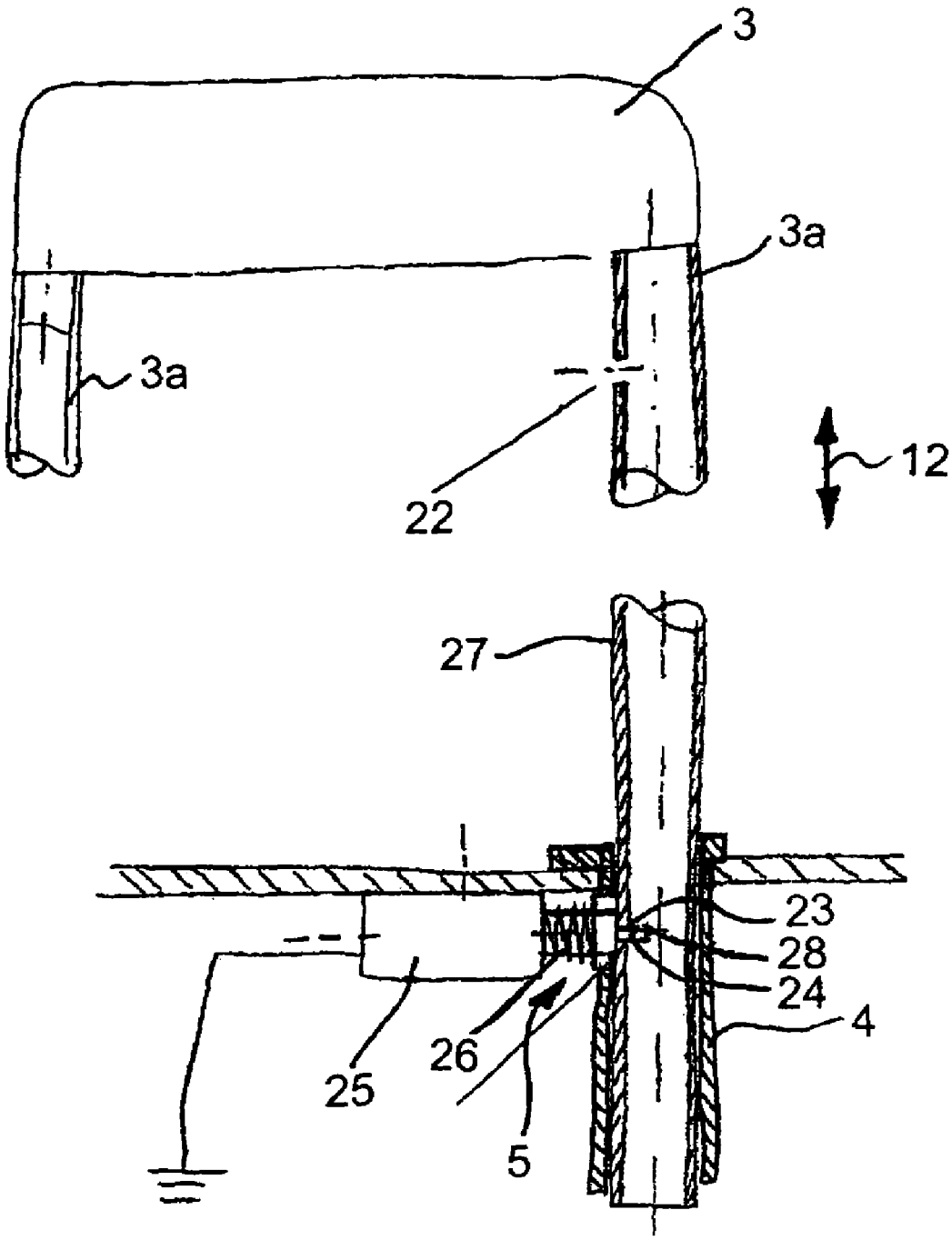
FIG. 2 is a diagrammatic, partial sectional view, in detail form, of a locking device of the drying and pressing apparatus.

FIG. 2 illustrates the locking device 5 in more detail. The top framework 3 has four tubes 3*a* (only two are illustrated), which are mounted for sliding action in the guide devices 4. A top undercut 22 and a bottom undercut 23, each in the form of a bore, are provided on a sliding tube 3*a*. The locking device 5, which is disposed on the bottom framework 1 adjacent to the guide device 4, also has a bolt 24 and a drive 25 for driving the bolt 24 out of the locked position (FIG. 2) into the non-illustrated unlocked position. The drive 25 is configured here as an electromagnet. A prestressing device 26 in the form of a spring is provided in order to move the bolt 24 from the unlocked position into the locked position. FIG. 2 illustrates the top framework 3 in the extended position in relation to the bottom framework 1, i.e. the bolt 24 is in engagement with the bottom undercut 23. The section of the tube 3*a* between the top undercut 22 and the bottom undercut 23 serves as a sliding rail 27 via which the front end of the bolt 24 slides when the locking device 5 is located in the locked position and the top framework 3 is located in an intermediate position between the retracted position and the extended position.

The bolt 24 has, at its front end, a sliding body 28 by way of which the bolt 24 is in contact with the sliding rail 27, the sliding body 28 having friction-reducing and impact-absorbing properties.

In order to start up the drying and pressing apparatus, in the first instance, the main switch 15 is set to "on".

The apparatus is initialized following actuation of the main switch 15, the function of at least one current-carrying component, preferably of all current-carrying components, being checked via respective test routines. If one or more malfunctions of components of the apparatus are detected, the apparatus is only partially freed for operation, if at all.

If malfunctions of components of the apparatus are detected during operation of the apparatus, then the apparatus is switched off or is only partially operational, or operational to a limited extent.

The apparatus is provided with a defect memory 40 which is integrated in the control device 14 and in which malfunctions of components of the apparatus that are detected during initialization or during operation of the apparatus are stored and can be read out again.

Upon initialization, the defect memory 40 is interrogated and, in the presence of stored malfunctions, the apparatus is only partially freed for operation, if at all.

The apparatus is normally located in the retracted state, i.e. the top framework 3 is retracted into the bottom framework 1. In order to extend the top framework 3, the unlocking input device 16 is actuated, the locking device 5 being unlocked and being retained in the unlocked position for a predetermined unlocking duration of preferably 2 seconds. During the unlocking duration of 2 seconds, the indicator lamp 20 illuminates in order to communicate the unlocked state to the user. In the unlocked state, the user can extend the top framework 3 out of the bottom framework 1, the unlocking duration of 2 seconds having elapsed, and the locking device dropping back into the locked position, in the interim.

For unlocking the bolt 24 of the locking device 5, the drive 25 is operated over an initial breakaway duration of preferably 0.03 to 0.5 s at a high power and over a following holding duration of preferably 1.5 to 1.97 s at a low power, which is lower than the high power. Once the unlocking duration has elapsed, the bolt 24 of the locking device 5 is moved back into the locked position (FIG. 2) by the prestressing device 26, which is preferably configured as a spring.

Since the electromagnet serving as the drive 25 is grounded, the top framework 3 cannot be energized via the bolt 24 in the event of a malfunction of the electromagnet. Rather, an electric fuse, which is part of the control device 14, interrupts the supply of power to the apparatus.

When the top framework 3 reaches the extended position, then the locking device 5 automatically latches in and locks the top framework 3 in relation to the bottom framework 1 in the extended position. If one of the end positions, such as the retracted position or extended position of the top framework 3, is reached and the unlocking duration has not yet elapsed, the locking device 5 is immediately locked in the respective end position without waiting for the unlocking duration to elapse. This allows reliable locking when one of the end positions is reached.

For retracting the top framework 3 into the bottom framework 1, the unlocking input device 16 has to be actuated again in order to effect unlocking, whereupon the top framework 3 can be retracted into the bottom framework 1. The locking device locks the top framework 3 in relation to the bottom framework 1 in a manner analogous to the locking operation when the top framework 3 is extended.

If the top framework 3 is located in the extended position, then the sensor device 6 senses this state, whereupon the control device 14 releases or enables the operation of the drying and pressing apparatus. The user can then pull an item of clothing, such as a shirt or the like, preferably in the damp state onto the pressing dummy 2. The user can then select an operating program at the program-input device 17, which is configured as a rotary actuator. The program-input device 17 has a zero position, in which no operating program is selected, and a multiplicity of further positions, in which an operating program is selected. If an operating program has been selected and an item of clothing has been pulled onto the pressing dummy, then the operation of the drying and pressing apparatus can be started via the start/stop button 18. The drying and pressing apparatus then executes the selected operating program stored in the control device 14. The control device emits a signal once the selected operating program has been completed. This signal may be an acoustic or optical signal. This "end of operating program" signal can be changed and switched on or off via the signal-setting input device 19.

Actuation of the start/stop button 18 for starting a preselected operating program switches on the fan 8 and, if appropriate, the heating device 9 for heating the air stream 11, whereupon the pressing dummy 2 inflates and the item of clothing mounted on the pressing dummy 2 is tensioned and dried and/or pressed.

If it is necessary, in the case of a set operating program, for the fan 8 and the permanent heater of the heating device 9 to be operated simultaneously, then the fan 8 is switched on just prior to the heating device 9 and, at the end of the operating program, the fan 8 is switched off after the heating device 9. Staggering the times retains the initial maximum power consumption at a relatively low level, with the result that the power supply is not overloaded even for a short period of time. Switching on the heating device 9 following the fan 8 and switching it off prior to the fan 8 ensures good heat dissipation from the heating coils of the heating device 9, which contains the permanent heater, and results in the heating device 9 not being adversely affected.

At least two, preferably three, different operating programs can be set by the adjustment of the program-input device 17. The operating programs contain:

a) "cold ventilation" with ambient air at the temperature $T_u$;

b) "warm ventilation" with a preheated air stream at the temperature $T_1$; and c) "pressing" with a preheated stream at the temperature $T_2$, which is higher than the temperature $T_1$ at least temporarily, preferably following the starting phase.

Each of the three operating programs has a multiplicity of operating sub-programs by which it is possible to preselect the duration of the set operating program.

For each operating program and each operating sub-program, the control device 14 stores a predetermined amount of work Ws or a predetermined duration t and/or a predetermined temperature T and/or a temperature profile over the duration for the air stream. In this case, the amount of work Ws or the duration t and/or the temperature T and/or the temperature profile of an operating program are/is predetermined in dependence on the material of an item of clothing which is to be treated, account being taken of the amount of work or the temperature and/or the temperature profile and/or the duration in dependence on the water-absorption capability of the material of the item of clothing which is to be treated, and the amount of work Ws or the duration and/or the temperature and/or the temperature profile being longer or higher in the case of material with a high level of water-absorption capability, such as flannel, than in the case of material with a lower level of water-absorption capability, such as silk.

The end of a preselected operating program, in particular the end of the heating phase, is reached when the integral of the power consumed over time corresponds to the amount of work Ws stored for the preselected operating program and/or when the duration t predetermined for an operating program has elapsed.

If the "pressing" operating program is selected, then the control device starts the preheating or charging of the heat accumulator 10. During the charging or preheating of the heat accumulator 10, an indicator lamp is illuminated to indicate this state. If the start/stop knot is actuated during the preheating or charging of the heat accumulator 10, then the controller only starts the preselected program when the preheating or charging has been completed.

If a "warm ventilation" or "pressing" operating program is selected, then these operating programs contains, at the end of the operating program, the cold ventilation phase with air at the temperature $T_u$ and a predetermined duration, in order to fix the item of clothing. At the end of an operating program, the control device 14 switches off the fan and/or the heating device and, as has already been mentioned, emits the "operating program at an end" signal.

If the start/stop button 18 is actuated as an operating program is running, then the operating program that is running is stopped. If, within a predetermined duration of preferably 30 seconds following actuation of the start/stop button 18, the start/stop button 18 is actuated again, then the interrupted operating program is continued at the point at which it was stopped. Once the predetermined duration of preferably 30 seconds following actuation of the start/stop button 18 for interrupting an operating program which is running has elapsed, renewed activation of the start/stop button 18 causes the set operating program to start from the beginning.

If a program is changed at the program-input device 17 as the current operating program is running, then this setting of a new operating program is taken into account only for the next operating cycle, the currently running operating program being executed to completion.

The currently running operating program or program step, such as the preheating of the heat accumulator, heat accumulator full, pressing, ventilation, cooling, is indicated by the indicating device 20, which is configured as a multiplicity of indicator lamps.

In an advantageous configuration, if the heat accumulator 10 has been preheated and is retained at the preheated level and, once a predetermined duration of preferably 30 minutes has elapsed, a pressing operating program does not start, an acoustic and/or optical signal are/is emitted, and/or the apparatus is switched off, with the result that the apparatus can only be operated again by actuation of the main switch, and/or the apparatus is switched into a rest mode in which the preheating of the heat accumulator 10 is switched off, the rest mode being terminated by actuation of the start switch or some other input device. This prevents the situation where the heat accumulator 10 is always retained in the preheated or charged state if the user has forgotten to switch off the apparatus properly via the main switch, and thus disconnect it from the power supply, following use.

As an alternative to providing a start/stop button 18 which integrates both functions, namely starting and stopping, in dependence on whether an operating program is running or not, it is also possible to provide two individual switches for which the starting or stopping functions are input separately.

This application claims the priority, under 35 U.S.C. § 119, of German patent application No. 103 50 507.5, filed Oct. 29, 2003; the entire disclosure of the prior application is herewith incorporated by reference.

We claim:

1. A method of operating a drying and pressing apparatus for items of clothing, the drying and pressing apparatus having a flexible pressing dummy which can be subjected to an action, from an inside, of an air stream generated by a fan, a top framework and a bottom framework, the pressing dummy having a first section connected to the top framework and a second section connected to the bottom framework, and it being possible for the top framework to be retracted into a retracted position in the bottom framework and extended out of the bottom framework into an extended position, the drying and pressing apparatus further having a locking device for locking the top framework in relation to the bottom framework in one of the retracted position and the extended position, and an unlocking input device for unlocking the locking device, which comprises the step of:

upon actuation of the unlocking input device, unlocking the locking device and retaining the locking device in an unlocked position for a predetermined unlocking duration.

2. The method according to claim 1, which further comprises during the predetermined unlocking duration, in dependence on a starting position of the top framework, moving the top framework in relation to the bottom framework either in a direction of the retracted position or in a direction of the extended position.

3. The method according to claim 2, which further comprises:

automatically putting the locking device into a locked state once the predetermined unlocking duration has elapsed;

if one of the end positions, being the retracted position or the extended position, is reached, automatically locking the locking device in the one end position; and if one of the end positions is reached and the predetermined unlocking duration has not yet elapsed, locking the locking device in the respective end position without waiting for the predetermined unlocking duration to elapse.

4. The method according to claim 2, which further comprises during the predetermined unlocking duration, indicating a state of the predetermined unlocking duration using an indicating device.

5. The method according to claim 4, which further comprises providing an unlocking indicator lamp as the indicating device.

6. The method according to claim 4, which further comprises setting the unlocking duration to last approximately 2 seconds.

7. The method according to claim 1, which further comprises switching on the apparatus by actuation of a main switch, the apparatus being initialized following actuation of the main switch.

8. The method according to claim 7, which further comprises upon initialization, checking a function of a current-carrying component through respective test routines, in which case if one or more malfunctions are detected, the apparatus is only partially freed for operation.

9. The method according to claim 8, which further comprises if a malfunction of at least one component of the apparatus is detected during operation of the apparatus, switching off the apparatus.

10. The method according to claim 8, which further comprises if a malfunction of at least one component of the apparatus is detected during operation of the apparatus, switching the apparatus to a partially operational state.

11. The method according to claim 1, which further comprises providing a memory to enable malfunctions of components of the apparatus to be stored.

12. The method according to claim 11, which further comprises upon initialization of the apparatus, accessing the memory.

13. The method according to claim 1, which further comprises:

operating a drive of the locking device, for unlocking purposes, over an initial breakaway duration of 0.03 to 0.5 s at a high power and over a following holding duration of 1.5 to 1.97 s at a low power, which is lower than the high power; and moving the locking device back into a locked position by a prestressing device once the predetermined unlocking duration has elapsed.

14. The method according to claim 13, which further comprises providing the drive as an electric drive, and the electric drive is grounded.

15. The method according to claim 13, which further comprises providing a spring as the prestressing device.

16. The method according to claim 13, which further comprises providing an electromagnetic lifting drive as the drive.

17. A method of operating a drying and pressing apparatus for items of clothing, the drying and pressing apparatus having a flexible pressing dummy which can be subjected to an action, from an inside, of an air stream generated by a fan, a top framework and a bottom framework, the pressing dummy having a first section connected to the top framework and a second section connected to the bottom framework, and it being possible for the top framework to be retracted into a retracted position in the bottom framework and extended out of the bottom framework into an extended position, the drying and pressing apparatus further having a locking device for locking the top framework in relation to the bottom framework in one of the retracted position and the extended position, and an unlocking input device for unlocking the locking device, which comprises:

upon actuation of the unlocking input device, unlocking the locking device and retaining the locking device in an unlocked position for a predetermined unlocking duration;

disposing the locking device on the bottom framework;

providing the locking device with a bolt which, for locking purposes, can be brought into engagement with a top or bottom undercut provided on the top framework; and disposing between the top and the bottom undercuts a sliding rail through which the bolt slides when the locking device is located in a locked position and the top framework is located in an intermediate position between the retracted position and the extended position.

18. The method according to claim 17, which further comprises providing the bolt with a sliding body by way of which the bolt comes into contact with the sliding rail, and in that the sliding body has friction-reducing and impact-absorbing properties.

19. The method according to claim 1, which further comprises:

providing an adjustable program-input device for selecting an operating program; and providing a start switch for starting a preselected operating program, the operating program, once selected, being started via actuation of the start switch.

20. The method according to claim 19, which further comprises when the preselected operating program is started, starting the fan and switching on a heating device for heating the air stream.

21. The method according to claim 20, which further comprises at an end of an operating program:

switching off at least one of the fan and the heating device; and emitting at least one signal selected from the group consisting of an acoustic signal and an optical signal.

22. The method according to claim 21, which further comprises providing a signal-setting input device for changing the signal and switching the signal on and off, and in the case of an acoustic signal, a loudness can be changed.

23. The method according to claim 20, which further comprises switching on the fan before the heating device.

24. The method according to claim 19, which further comprises setting a multiplicity of different operating programs by adjusting the program-input device.

25. The method according to claim 24, which further comprises:

for each of the operating programs, storing in a control device an amount of work in dependence on parameters including at least one of a volume flow of the air stream, a temperature of the air stream, and a duration of the air stream; and reaching an end of the preselected operating program when an integral of power consumed over time corresponds to the amount of work stored for the preselected operating program.

26. The method according to claim 25, which further comprises:

predetermining at least one of the amount of work, the duration, the temperature and the temperature profile of the operating program in dependence on a material of an item of clothing which is to be treated, account being taken of at least one of the amount of work, the temperature, the temperature profile and the duration in dependence on a water-absorption capability of the material of the item of clothing which is to be treated, and at least one of the amount of work, the duration, the temperature, and the temperature profile being longer or higher in the case of material with a high level of water-absorption capability, than in the case of material with a lower level of water-absorption capability.

27. The method according to claim 24, which further comprises forming the operating programs to contain information relating to a cold ventilation process with ambient air at a first temperature, a warm ventilation process with a preheated air stream at a second temperature, and pressing process with a preheated stream at a third temperature, which is higher than the second temperature at least temporarily, following a starting phase.

28. The method according to claim 27, which further comprises for a pressing operating program:

preheating a heat accumulator of a heating device to a predetermined quantity of heat;

starting the preheating of the heat accumulator upon preselection of the pressing process being a pressing operating program; and starting the pressing operating program, upon actuation of the start switch, only when preheating is completed.

29. The method according to claim 28, which further comprises during the preheating and/or at an end of the preheating of the heat accumulator, indicating that the heat accumulator has been preheated using an indicating device.

30. The method according to claim 28, which further comprises when the heat accumulator has been preheated and is retained at a preheated level and, when a predetermined duration has elapsed, and a pressing operating program has not started, emitting at least one of an acoustic signal and an optical signal, and/or switching off the apparatus, and the apparatus can only be operated again by actuation of a main switch, and/or the apparatus is switched into a rest mode in which the preheating of the heat accumulator is switched off, a rest mode being terminated by actuation of the start switch.

31. The method according to claim 30, which further comprises setting the predetermined duration to be 30 minutes.

32. The method according to claim 27, which further comprises at an end of the warm ventilation process and/or the pressing process, performing the cold ventilation process with a predetermined duration for fixing the item of clothing.

33. The method according to claim 24, which further comprises providing each of the operating programs with a multiplicity of operating sub-programs by which it is possible to preselect a duration of a set operating program.

34. The method according to claim 24, which further comprises:

for each of the operating programs, storing in a control device at least one of a predetermined duration, a predetermined temperature and a temperature profile over the predetermined duration for the air stream; and reaching an end of the preselected operating program when the predetermined duration has ended.

35. The method according to claim 19, which further comprises:

setting a new operating program while running a current operating program;

taking into account a change in program for a next operating cycle; and executing the current operating program to completion.

36. The method according to claim 19, which further comprises providing a stop switch and actuation of the stop switch stops the operating program at any point in time.

37. The method according to claim 36, which further comprises during a running of the operating program, stopping the operating program upon actuation of the stop switch and, within a predetermined duration of time, actuation of the start switch causes the operating program to be continued at a point at which it was stopped and, once the predetermined duration has elapsed, actuation of the start switch causes a set operating program to start from the beginning.

38. The method according to claim 36, which further comprises as a current operating program is running, stopping the current operating program upon actuation of the stop switch and if, within a predetermined duration of time, an operating program other than the currently running operating program is set, the current operating program is broken off and, and upon actuation of the start switch, the other operating program is started.

39. A method of operating a drying and pressing apparatus for items of clothing, the drying and pressing apparatus having a flexible pressing dummy which can be subjected to an action, from an inside, of an air stream generated by a fan, a top framework and a bottom framework, the pressing dummy having a first section connected to the top framework and a second section connected to the bottom framework, and it being possible for the top framework to be retracted into a retracted position in the bottom framework and extended out of the bottom framework into an extended position, the drying and pressing apparatus further having a locking device for locking the top framework in relation to the bottom framework in one of the retracted position and the extended position, and an unlocking input device for unlocking the locking device, which comprises:

upon actuation of the unlocking input device, unlocking the locking device and retaining the locking device in an unlocked position for a predetermined unlocking duration;

sensing the extended position of the top framework using a sensor device, and the drying and pressing apparatus is ready for operation only when the extended position of the top framework is sensed.

40. A drying and pressing apparatus for items of clothing, comprising:

a fan;

a flexible pressing dummy having an interior which can be subjected to an air stream generated by said fan;

a top framework;

a bottom framework, said flexible pressing dummy having a first section connected to said top framework and a second section connected to said bottom framework, said top framework being retractable into a retracted position in said bottom framework and extended out of said bottom framework into an extended position;

a locking device for locking said top framework in relation to said bottom framework in the retracted position or in the extended position; and a input panel having an unlocking input device for unlocking said locking device, upon actuation of said unlocking input device said locking device being unlocked for a predetermined unlocking duration.

41. The apparatus according to claim 40, wherein said input panel has an adjustable program-input device for selecting an operating program and a start switch for starting a preselected operating program.

42. The apparatus according to claim 40, further comprising a heating device having a heat accumulator for heating the air stream.

43. The apparatus according to claim 41, wherein said input panel has a signaling device for emitting at least one signal selected from the group consisting of acoustic signals and optical signals at an end of the operating program.

44. The apparatus according to claim 43, wherein said input panel has a signal-setting input device, by which the signal of said signaling device can be changed and switched on or off, and in a case of an acoustic signal, a loudness can be changed.

45. The apparatus according to claim 40, wherein said input panel has a stop button; actuation of said stop button stopping an operating program which is running at any point in time.

46. The apparatus according to claim 40, wherein said input panel has a main switch for switching the apparatus on and off.

47. The apparatus according to claim 41, wherein said input panel has a single button for starting and stopping operating functions for starting and stopping the preselected operating program.

48. A drying and pressing apparatus for items of clothing comprising, a flexible pressing dummy which can be subjected to an action, from an inside, of an air stream generated by a fan;

a top framework;

a bottom framework;

a first section connected to the top framework;

a second section connected to the bottom framework, wherein the top framework is capable of being retracted into a retracted position in the bottom framework and extended out of the bottom framework into an extended position;

a locking device for locking the top framework in relation to the bottom framework in one of the retracted position and the extended position;

an unlocking input device for unlocking the locking device and retaining the locking device in an unlocked position for a predetermined unlocking duration; and an input panel disposed on the bottom framework and is connected for signal exchange purposes to the unlocking input device for controlling the drying and pressing apparatus.

* * * * *